US007445702B2

(12) United States Patent
Abbott

(10) Patent No.: US 7,445,702 B2
(45) Date of Patent: Nov. 4, 2008

(54) DESULPHURISATION

(75) Inventor: Peter Edward James Abbott, Cleveland (GB)

(73) Assignee: Johnson Matthey PLC, London (GB)

( * ) Notice: Subject to any disclaimer, the term of this patent is extended or adjusted under 35 U.S.C. 154(b) by 437 days.

(21) Appl. No.: 10/532,616

(22) PCT Filed: Oct. 30, 2003

(86) PCT No.: PCT/GB03/04648

§ 371 (c)(1),
(2), (4) Date: Apr. 25, 2005

(87) PCT Pub. No.: WO2004/044096

PCT Pub. Date: May 27, 2004

(65) Prior Publication Data

US 2006/0011515 A1 Jan. 19, 2006

(30) Foreign Application Priority Data

Nov. 11, 2002 (GB) ..... 0226178.2

(51) Int. Cl.

| | |
|---|---|
| ***C10G 45/00*** | (2006.01) |
| ***C10G 27/04*** | (2006.01) |
| ***C10G 45/04*** | (2006.01) |
| ***C10G 29/00*** | (2006.01) |
| ***B01D 3/34*** | (2006.01) |

(52) U.S. Cl. ..... 208/208 R; 208/213; 208/215; 208/217; 208/240; 208/244; 208/246; 208/249; 203/28; 203/29; 203/31

(58) Field of Classification Search ..... 208/208 R, 208/213, 215, 217, 240, 244, 246, 249, 243, 208/189, 139; 203/28, 29, 31
See application file for complete search history.

(56) References Cited

U.S. PATENT DOCUMENTS

| | | | | | |
|---|---|---|---|---|---|
| 3,839,192 | A | * | 10/1974 | Hayes | 208/139 |
| 4,150,962 | A | * | 4/1979 | Colton | 62/625 |
| 4,311,683 | A | * | 1/1982 | Hass et al. | 423/576.8 |
| 4,481,106 | A | * | 11/1984 | Verachtert | 208/206 |
| 4,490,246 | A | * | 12/1984 | Verachtert | 208/206 |
| 4,700,004 | A | * | 10/1987 | Macdonell et al. | 568/26 |
| 5,169,516 | A | * | 12/1992 | Carr | 208/189 |
| 5,320,742 | A | * | 6/1994 | Fletcher et al. | 208/89 |
| 5,449,501 | A | * | 9/1995 | Luebke et al. | 422/193 |

(Continued)

FOREIGN PATENT DOCUMENTS

| | | |
|---|---|---|
| WO | WO-94/09090 | 4/1994 |

(Continued)

*Primary Examiner*—Walter D Griffin
*Assistant Examiner*—Huy-Tram Nguyen
(74) *Attorney, Agent, or Firm*—RatnerPrestia

(57) ABSTRACT

Propane and/or butanes are separated from a hydrocarbon feedstock contaminated with alkyl mercaptans by fractional distillation at such a pressure that the separated overheads stream containing said propane and/or butanes is at a temperature in the range 50 to 100° C. Sufficient oxygen is introduced into the hydrocarbon feedstock to oxidise the mercaptans therein and the resultant mixture is subjected to the fractional distillation in a column including at least one bed of a catalyst capable, under the prevailing conditions, of oxidising the mercaptans to higher boiling point sulphur compounds. These higher boiling point sulphur compounds are separated as part of the liquid phase from the distillation.

8 Claims, 1 Drawing Sheet

U.S. PATENT DOCUMENTS

| | | | | | |
|---|---|---|---|---|---|
| 5,463,134 | A * | 10/1995 | Frey | 568/59 |
| 5,595,634 | A * | 1/1997 | Hearn et al. | 203/29 |
| 5,659,106 | A * | 8/1997 | Frey et al. | 585/803 |
| 5,741,415 | A * | 4/1998 | Mazgarov et al. | 208/195 |
| 5,849,656 | A * | 12/1998 | Mazgarov et al. | 502/185 |
| 5,851,383 | A * | 12/1998 | Frey | 208/217 |
| 5,907,064 | A * | 5/1999 | Shaw | 568/21 |
| 6,175,007 | B1 * | 1/2001 | Zagar et al. | 544/242 |
| 6,440,299 | B2 | 8/2002 | Hearn et al. | |
| 6,441,263 | B1 * | 8/2002 | O'Rear et al. | 585/650 |
| 7,223,332 | B1 * | 5/2007 | Tertel | 208/208 R |
| 2002/0130062 | A1 * | 9/2002 | Wismann et al. | 208/189 |
| 2002/0157990 | A1 * | 10/2002 | Feimer et al. | 208/243 |
| 2003/0085181 | A1 * | 5/2003 | Greaney et al. | 210/749 |
| 2003/0094414 | A1 * | 5/2003 | Greaney et al. | 210/638 |
| 2003/0178342 | A1 * | 9/2003 | Alexion et al. | 208/208 R |

FOREIGN PATENT DOCUMENTS

| | | |
|---|---|---|
| WO | WO-97/03149 | 1/1997 |

* cited by examiner

DESULPHURISATION

This application is the U.S. national phase application of PCT International Application No. PCT/GB2003/004648, filed Oct. 30, 2003, and claims priority of British Patent Application No. 0226178.2, filed Nov. 11, 2002.

FIELD OF THE INVENTION

This invention relates to desulphurisation and in particular to the desulphurisation of hydrocarbon streams.

BACKGROUD OF THE INVENTION

Natural gas contains a variety of hydrocarbons, predominantly saturated, together with contaminants particularly sulphur compounds. It is often desirable to separate the hydrocarbon stream into fractions. The $C_2$ and higher hydrocarbons are generally separated from methane by liquefaction and then the resultant liquid stream, hereinafter natural gas liquids, may be separated into fractions, e.g. ethane, propane, butanes, and a higher hydrocarbon stream, hereinafter termed a gasoline fraction. In some instances it is desired to separate the butanes stream into n-butane and iso-butane.

The separation into fractions is usually effected by fractional distillation wherein the hydrocarbon feed is fed to a fractional distillation column. A temperature gradient is established between the top and bottom of the column so that the more volatile components are separated as an overhead gas stream while the less volatile components are discharged from the bottom of the column as a liquid stream. The column is usually operated with heat supplied to the lower end of the column by boiling part of the separated liquid stream and returning the vaporised liquid to the column. Similarly the vapour stream from the upper end of the column is cooled to condense part thereof. The condensate is returned to the upper end of the column.

The separation of the natural gas liquids is often effected in a series of stages. In a first stage, the ethane is separated as the overhead stream in a first column, termed a de-ethaniser, giving a liquid stream containing $C_3$ and higher hydrocarbons. This stage is normally effected at elevated pressure with refrigeration to condense the liquid phase. The liquid stream containing $C_3$ and higher hydrocarbons is then fed to a second column, termed a de-propaniser, wherein the propane is separated as the overhead gaseous phase. The resulting $C_3$-depleted liquid hydrocarbon stream is then fed to a further column, termed a de-butaniser, wherein butanes are separated as the overhead stream from higher hydrocarbons. The higher hydrocarbons form the gasoline fraction. As indicated above in some cases the butanes stream may be separated into normal and isobutane by means of a butanes splitter column. So that water can be used to effect the cooling of the overhead stream in the de-propaniser and de-butaniser (and butanes splitter, if used), the distillation is effected at such an elevated pressure that the temperature of the vapour fed to the overhead condenser is at a temperature in the range 50 to 100° C.

Natural gas generally contains a variety of sulphur compounds including hydrogen sulphide, carbonyl sulphide, alkyl mercaptans, alkyl sulphides and disulphides. The atmospheric pressure boiling points of the common sulphur contaminants and the paraffins is shown in the following table.

| Material | Atmospheric pressure boiling point (° C.) |
|---|---|
| ethane | −89 |
| carbonyl sulphide | −48 |
| propane | −44 |
| hydrogen sulphide | −42 |
| i-butane | −12 |
| n-butane | 0 |
| methyl mercaptan | 8 |
| pentanes | 10-36 |
| ethyl mercaptan | 35 |
| dimethyl sulphide | 38 |
| Other sulphur compounds | >50 |

The sulphur compounds thus have a range of boiling points and so, depending on their volatility, would normally separate into the appropriate hydrocarbon fraction. Thus the ethane and propane streams would normally be contaminated with hydrogen sulphide, carbonyl sulphide and methyl mercaptan. The butanes stream would normally be contaminated with methyl and ethyl mercaptans and dimethyl sulphide. If a butanes splitter is employed, the methyl mercaptan will separate into the i-butane stream, with the ethyl mercaptan and dimethyl sulphide in the n-butane stream. The gasoline fraction will be contaminated with methyl and ethyl mercaptans, dimethyl sulphide and higher sulphur compounds.

The presence of the sulphur compounds in the various fractions is generally undesirable as the sulphur compounds donate a characteristic unpleasant odour and also may render the fraction corrosive and/or poison catalysts employed in downstream treatment of the fraction.

Hydrogen sulphide and carbonyl sulphide can readily be removed from the natural gas by a suitable pre-treatment step. Thus the natural gas can be passed through a material that will hydrolyse carbonyl sulphide into carbon dioxide and hydrogen sulphide. The hydrogen sulphide, and if desired, the carbon dioxide, can be removed by suitable absorption techniques. Thus "wet" processes may be employed wherein the hydrogen sulphide and carbon dioxide is absorbed by a suitable regenerable absorbent liquid such as diethanolamine. Alternatively hydrogen sulphide can be removed by a suitable solid absorbent such as zinc oxide. The removal of the mercaptans, sulphides and disulphides presents more of a problem.

Mercaptans and other sulphur compounds can be removed by hydro-desulphurisation to convert the sulphur compounds to hydrogen sulphide followed by removal of the hydrogen sulphide by conventional absorption processes as described above. However it is generally inconvenient to subject the feedstock natural gas, or the natural gas liquids, stream to hydro-desulphurisation prior to fractionation, or to subject each of the fractions to hydro-desulphurisation and hydrogen sulphide removal.

It is known that mercaptans can react with oxygen in the presence of a catalyst to form disulphides and water. This process has been used in the refining industry for sweetening hydrocarbon fluids such as butanes, diesel and kerosene. In the present invention, the catalytic oxidation is effected in a distillation process so that the mercaptans are oxidised to higher boiling sulphur compounds and so largely become part of the gasoline stream. That stream may be subjected to hydro-desulphurisation, and separation of hydrogen sulphide, if required.

Catalytic distillation of hydrocarbons to remove sulphur compounds has been proposed in WO 97/03149. However in that reference the petroleum stream was subjected to hydrodesulphurisation by the catalytic distillation process, so that the organic sulphur compounds are converted to hydrogen sulphide which is separated as part of the vapour overhead stream. In contrast, in the present invention, the sulphur compounds are oxidised and separated as part of the liquid stream.

SUMMARY OF THE INVENTION

The present invention provides a process whereby propane and/or butanes are separated from a hydrocarbon feedstock contaminated with alkyl mercaptans by fractional distillation at such a pressure that the separated overheads stream containing said propane and/or butanes is at a temperature in the range 50 to 1000° C. Sufficient oxygen is introduced into the hydrocarbon feedstock to oxidise the mercaptans therein and the resultant mixture is subjected to the fractional distillation in a column including at least one bed of a catalyst capable, under the prevailing conditions, of oxidising mercaptans to higher boiling point sulphur compounds. These higher boiling point sulphur compounds are separated as part of the liquid phase from the distillation.

DETAILED DESCRIPTION OF THE INVENTION

Figure 1:
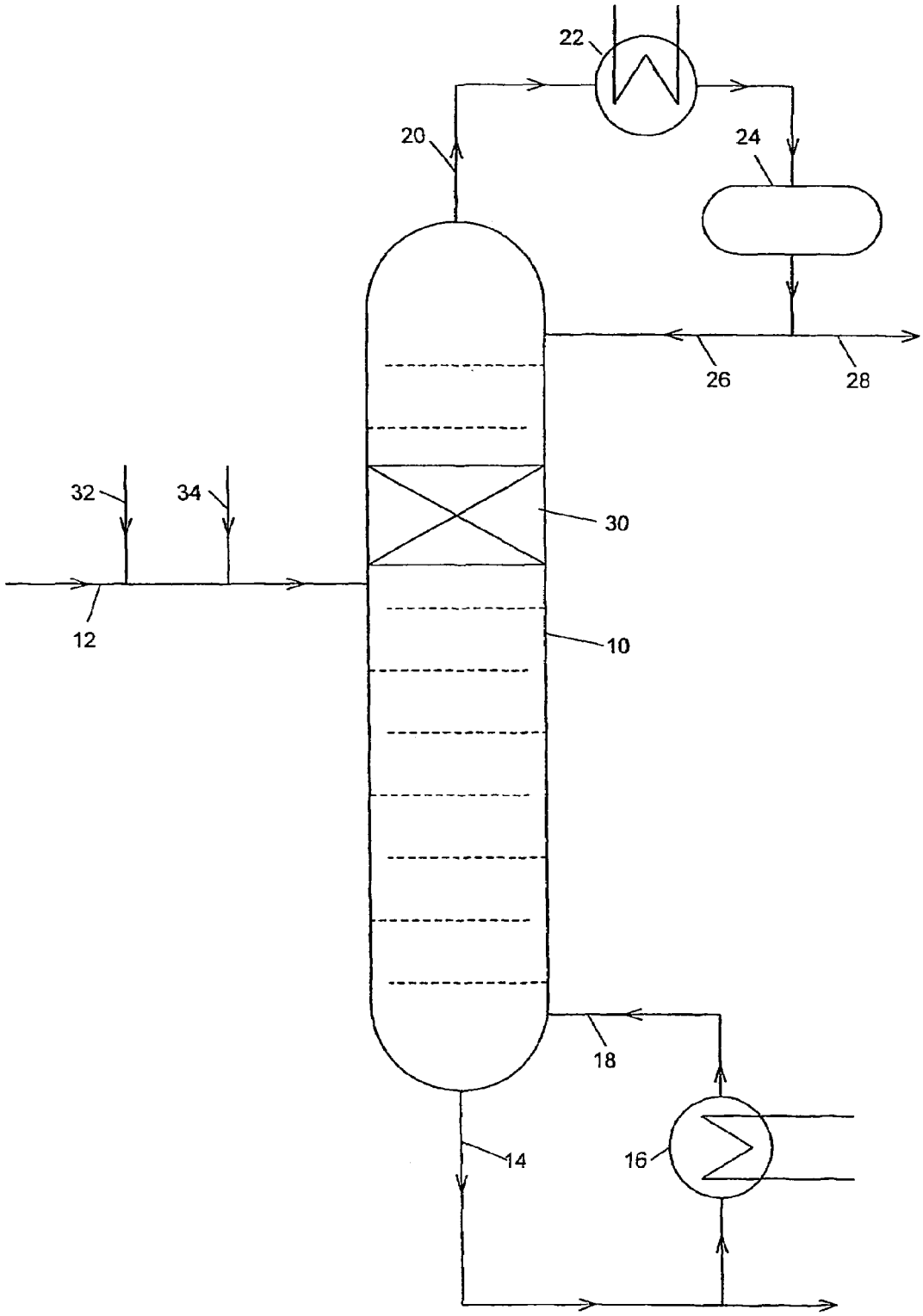
FIG. 1 is a schematic diagram flow sheet of one embodiment of the invention.

The present invention provides a process for the separation of a stream containing propane and/or butanes from a hydrocarbon feedstock contaminated with alkyl mercaptans by fractional distillation at such a pressure that the separated overheads stream containing said propane and/or butanes is at a temperature in the range 50 to 100° C., comprising introducing sufficient oxygen into said hydrocarbon feedstock to oxidise the mercaptans therein and subjecting the resultant mixture to the fractional distillation column including at least one bed of a catalyst capable, under the prevailing conditions, of oxidising mercaptans to higher boiling point sulphur compounds, and separating the higher boiling point sulphur compounds as part of the liquid phase from the distillation.

By the oxidation process mercaptans such as methyl mercaptan and ethyl mercaptan are oxidised to the corresponding disulphides which have atmospheric pressure boiling points well in an excess of 100° C., and so, instead of distilling as part of the overhead propane and/or butanes stream, will remain in the liquid stream. A further benefit of the process of the invention is that mercaptans, especially methyl mercaptan, may be formed in the reflux boiler by the disproportionation of other sulphur compounds. The process of the invention can therefore remove these mercaptans as they are formed.

The amount of mercaptans present in the hydrocarbon feedstock will generally be less than 2000 ppm, and typically will be in the range 100 to 1000 ppm by volume. Typically about half of the total mercaptans present will be methyl and ethyl mercaptan. The amount of oxygen required for the oxidation will thus generally be relatively small and, at the pressures employed, the hydrocarbon feedstock can dissolve sufficient air to supply that amount of oxygen.

The distillation is generally effected at a pressure in the range 5 to 25 bar abs., and will determine the overheads temperature required to effect the distillation.

Catalysts that may be used to effect the oxidation include transition metal catalysts, particularly those based on cobalt and/or manganese and/or copper. These include the catalysts, which are generally copper-based or cobalt based, e.g. cobalt supported on carbon, that have been used in the aforementioned hydrocarbon sweetening processes. Optionally other metals are present in the catalyst, e.g. alkali metal compounds. As an example, one typical catalyst is a granular material sold by Johnson Matthey Catalysts as Johnson Matthey KSR and comprises 10-12% by weight copper sulphate, 6-8% by weight sodium chloride and 10-20% by weight of water on a clay support. This is active at the temperatures prevailing in the distillation column.

In order to maximise the activity of the catalyst it may be necessary to adjust the water content of the feed to maintain the water content of the catalyst at or near its optimum value by balancing the water added, and the water produced by the reaction, with the water removed in the overhead and liquid fractions. Generally, the amount of water that need be incorporated into the hydrocarbon feed is such that it is miscible with the hydrocarbon stream under the prevailing conditions.

The catalyst is preferably disposed as a fixed bed within the distillation column. A column having a modular packing structure may be employed with the catalyst loaded as an individual bed in each module.

The invention is illustrated by reference to the accompanying drawing which is a diagrammatic flowsheet of one embodiment of the invention.

In FIG. 1 there is shown a de-butaniser fractional distillation column 10 used for the separation of butanes from the liquid hydrocarbon stream from de-propaniser The liquid hydrocarbon stream 12 is supplied to the column at a location part way up the column. Typically the column may have 20 or more stages and typically at least a third, preferably at least half, but not more than three quarters, of the stages will be below the location oat which the feed is supplied. The column is provided at its lower end with a liquid offtake 14. Part of the liquid hydrocarbon stream removed from the bottom of the column is heated in a reboiler 16 and recycled to the lower end of the column via line 18. The remainder of the liquid stream from the lower end of the column constitutes a gasoline stream.

At the upper end of the column 10 an overhead vapour stream, comprising the butanes, is taken via line 20. This vapour is cooled in a heat exchanger 22, which may be cooled by water or air, to condense the vapour which is fed to a drum 24. Part of the condensed liquid butanes are recycled to the top of the column via line 26 and the remainder taken as a product butanes stream 28. Disposed in the column, preferably above the hydrocarbon feed location, is a fixed bed 30 of an oxidation catalyst, for example Johnson Matthey KSR. Lines 32 and 34 are provided for the injection of air and water respectively into the hydrocarbon feed stream 12.

The column is operated at such a pressure, e.g. 10 bar abs., that the temperature of the vapour in line 20 is in the range 50 to 100° C. Typically the temperature of the liquid stream at the lower end of the column is 20 to 60° C. greater than that of the vapour in line 20.

In operation a small amount of air and water are injected into the hydrocarbon feed stream 12. The amounts of air and water injected are such that they dissolve in the hydrocarbon stream thus giving a single phase. In the column, the mercaptans in the feedstock are oxidised by the catalyst forming higher boiling sulphur compounds which separate as part of the gasoline stream, leaving the butanes product stream essentially free from sulphur compounds.

As a calculated example, the liquid stream from a de-propaniser had the following volume composition

| | |
|---|---|
| propane | 1.3% |
| n-butane | 33.0% |
| i-butane | 30.3% |
| n-pentane | 35.3% |

It also contained 124 ppm of methyl mercaptan, 141 ppm of ethyl mercaptan and 71 ppm of dimethyl sulphide (all ppm are by volume). The liquid stream was fed at a rate of 70 kmol/h (about 1500 bpd) to a de-butaniser operated at 10 bar abs, with a reflux ratio of 2, an overhead temperature of 70° C., a bottoms temperature of 120° C. and 20 stages below the feed point and 10 stages above the feed point. Air and water were injected into the liquid feed at rates of 0.022 kmol/h and 0.025 kmol/h respectively. 0.5 $m^3$ of Johnson Matthey KSR catalyst granules was disposed as a fixed bed in the column above the feed tray.

It is calculated that the product composition was as shown in the following table. In the table is also quoted the calculated composition if the catalyst bed and the injection of water and air are omitted.

| | | | Oxidation | |
|---|---|---|---|---|
| | | | omitted | included |
| Feed | Hydrocarbons | kmol/h | 70 | 70 |
| | Water | kmol/h | 0 | 0.025 |
| | Air | kmol/h | 0 | 0.022 |
| Overhead stream | Propane/butanes | kmol/h | 43.2 | 43.2 |
| | Methyl mercaptan | ppm | 194 | 0 |
| | Ethyl mercaptan | ppm | 8 | 0 |
| | Dimethyl sulphide | ppm | 2 | 2 |
| | Oxygen | ppm | 0 | 15 |
| | Nitrogen | ppm | 0 | 410 |
| | Water | ppm | 0 | 505 |
| Gasoline stream | Butanes/pentane | kmol/h | 26.8 | 26.8 |
| | Methyl mercaptan | ppm | 10 | 3 |
| | Ethyl mercaptan | ppm | 356 | 125 |
| | Dimethyl sulphide | ppm | 180 | 180 |
| | Dimethyl disulphide | ppm | 0 | 160 |

-continued

| | | Oxidation | |
|---|---|---|---|
| | | omitted | included |
| Diethyl disulphide | ppm | 0 | 122 |
| Water | ppm | 0 | 400 |

The invention claimed is:

1. A process for the separation of a stream containing propane and/or butanes from a natural gas liquid contaminated with alkyl mercaptans by fractional distillation at such a pressure that a separated overheads stream containing said propane and/or butanes is at a temperature in the range 50 to 100° C., comprising introducing sufficient oxygen into said natural gas liquid to oxidise the mercaptans therein and subjecting the resultant mixture to the fractional distillation in a column including at least one bed of a catalyst capable, under the prevailing conditions, of oxidising mercaptans to higher boiling point sulphur compounds, and separating the higher boiling point sulphur compounds as part of a liquid phase from the distillation.

2. A process according to claim 1 wherein the catalyst comprises a granular material containing a transition metal on a support.

3. A process according to claim 2 wherein the transition metal comprises copper, manganese or cobalt or a mixture of two or more of these.

4. A process according to claim 3 wherein the catalyst is a granular material comprising copper sulphates, sodium chloride and water on a clay support.

5. A process according to claim 1 wherein the amount of mercaptans present in the natural gas liquid is less than 2000 ppm volume.

6. A process according to claim 1 wherein the distillation is effected at a pressure in the range 5 to 25 bar abs.

7. A process according to claim 1 wherein the oxygen is supplied by dissolving air in the natural gas liquid.

8. A process according to claim 1 wherein water is incorporated into the natural gas liquid in such an amount that it is miscible with the natural gas liquid under the prevailing conditions.

* * * * *